US005630522A

United States Patent [19]

Montgomery

[11] Patent Number: 5,630,522

[45] Date of Patent: May 20, 1997

[54] DUAL CONTACT PLUG SEAL FOR THREADED CLOSURE

[75] Inventor: Gary V. Montgomery, Evansville, Ind.

[73] Assignee: Rexam Closures, Inc., Evansville, Ind.

[21] Appl. No.: 599,064

[22] Filed: Feb. 9, 1996

[51] Int. Cl.[6] ..... B65D 53/00

[52] U.S. Cl. ..... 215/344; 215/354; 215/DIG. 1

[58] Field of Search ..... 215/344, DIG. 1, 215/354, 341

[56] References Cited

U.S. PATENT DOCUMENTS

| | | | |
|---|---|---|---|
| 3,568,871 | 3/1971 | Livingstone | 215/344 |
| 3,881,627 | 5/1975 | Davolt | 215/344 X |
| 3,979,004 | 9/1976 | Bertario . | |
| 4,016,996 | 4/1977 | Aichinger et al. . | |
| 4,210,251 | 7/1980 | Grussen . | |
| 4,415,095 | 11/1983 | Schweigert et al. . | |
| 4,489,845 | 12/1984 | Aichinger et al. . | |
| 4,739,893 | 4/1988 | Zumbuhl . | |
| 4,823,967 | 4/1989 | Thompson | 215/344 X |
| 5,161,707 | 11/1992 | Dutt et al. | 215/344 |
| 5,275,287 | 1/1994 | Thompson . | |
| 5,385,252 | 1/1995 | Hidding et al. | 215/344 X |
| 5,450,973 | 9/1995 | Ellis et al. . | |

*Primary Examiner*—Jes F. Pascua
*Assistant Examiner*—Nathan Newhouse
*Attorney, Agent, or Firm*—Gifford, Krass, Groh, Sprinkle, Patmore, Anderson & Citkowski, P.C.

[57] ABSTRACT

A threaded closure is provided for engaging a threaded container neck. The closure has a dual sealing plug which provides a primary continuous rotary seal and a secondary self centering seal with the inside surface of the container neck.

3 Claims, 1 Drawing Sheet

DUAL CONTACT PLUG SEAL FOR THREADED CLOSURE

BACKGROUND OF THE INVENTION

1. Field of the Invention

This invention relates to a closure for a threaded container neck, and, more particularly, this invention relates to a threaded closure having a plug seal.

2. State of the Art

There are a variety of threaded closures having plug seals which engage an internal surface of a container neck. Some of these threaded closures also have an independent secondary seal, usually in the form of a fin seal projecting downwardly from the cap top between the outer cap skirt and the plug seal. This type of secondary top seal has no threading torque magnification.

SUMMARY OF THE INVENTION

The present invention is directed to a threaded closure which has a dual sealing plug providing a continuous rotary seal and a threading torque magnified secondary seal.

The closure has a top with a cylindrical cap skirt depending from the periphery of the top. The cap skirt has an internal thread for engaging the threaded container neck. A dual sealing plug comprises an inner skirt depending from the top inwardly of the cap skirt for engaging an internal surface of the container neck. The plug includes an inwardly directed conical section depending from the cap top creating a secondary seal as it contacts the internal neck surface adjacent the lip end of the container neck. The plug also has a rotary seal portion extending downwardly from the conical section creating a continuous rotary seal as it engages the internal surface of the container neck.

In one embodiment the rotary seal portion of the plug diverges outwardly from the conical section to contact the cylindrical internal surface of the container neck to create the continuous rotary seal.

In another embodiment the rotary seal portion of the plug extends vertically down from the conical section to provide a cylindrical portion which is contacted by a bead extending inwardly from the cylindrical internal surface of the container neck to create the continuous rotary seal.

DRAWING

The advantages of the present invention will be more apparent from the following detailed description when considered in connection with the accompanying drawing wherein.

PRESCRIPTION OF THE PREFERRED EMBODIMENT

Figure 1:
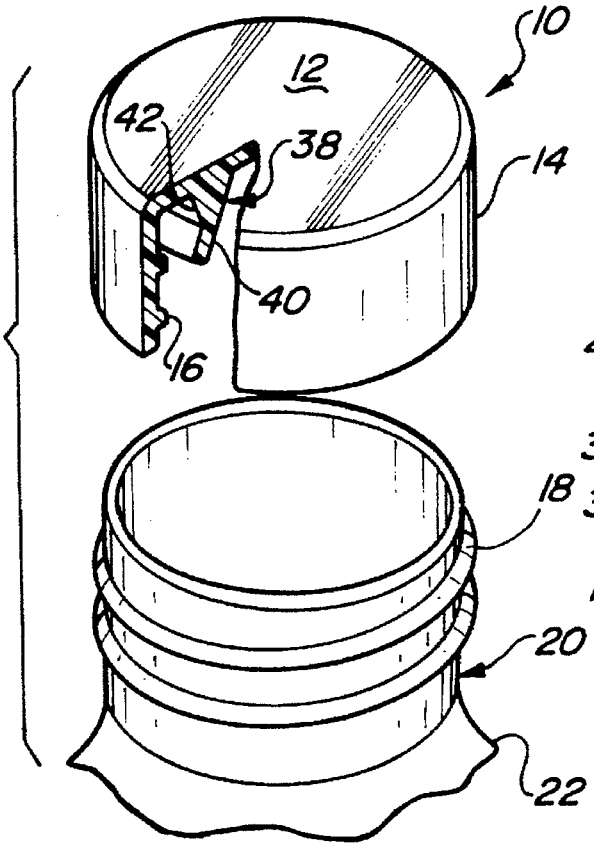
FIG. 1 is an exploded perspective view of the closure cap according to the invention as it is applied to a container having a standard threaded neck finish.

Referring to FIG. 1, the closure 10 of the present invention is a threaded closure cap having a flat top 12 and an annular skirt 14 with an internal helical thread 16 for engaging a complementary thread 18 on the neck 20 of a container 22.

Figure 3:
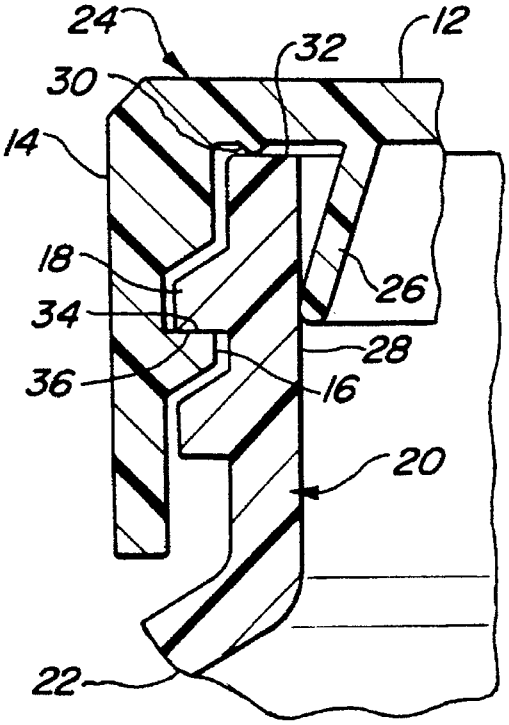
FIG. 3 is a partial elevational view in cross section similar to FIG. 2 showing a state of the art closure having primary and secondary seals.

In the state of the art closure 24 of FIG. 3, a diverging inner skirt 26 depending from cap top 12 acts as a continuous or rotary plug seal which maintains sealing contact with the inner surface 28 of the container neck 20 as the cap is unthreaded. A secondary seal is provided by a circumferential fin 30 projecting downwardly from the cap top 12 between the annular cap skirt 14 and the inner plug skirt 26. The fin 30 contacts the container neck lip surface 32 with a sealing force opposed to the closing force exerted by the upper surface 34 of the cap thread 16 against the lower surface 36 of the container neck thread 18. If there are imperfections in the container neck sealing lip surface 32, it can be impossible to establish enough closing force to effect the secondary seal.

Figure 2:
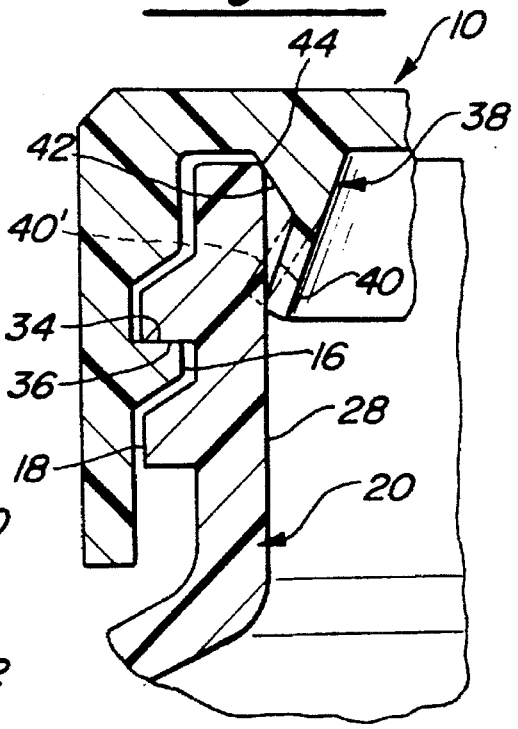
FIG. 2 is a partial elevational view in cross section showing the closure cap applied to the container neck.
Figure 4:
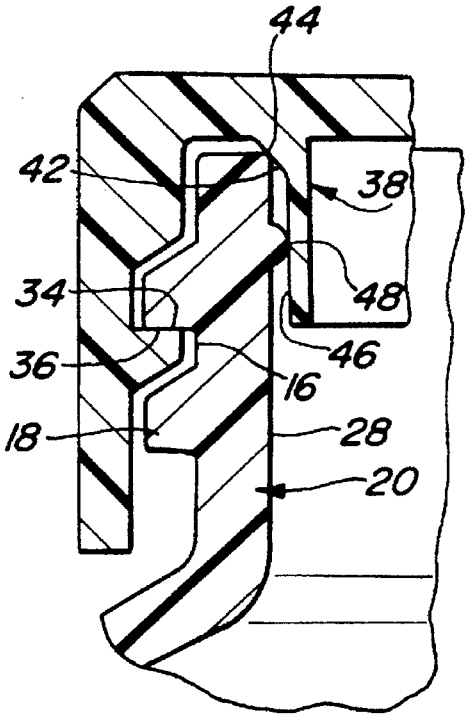
FIG. 4 is a partial elevational view in cross section similar to FIG. 2 showing another embodiment of the closure cap of the invention applied to the container neck.

In the closure 10 of the invention shown in FIGS. 1, 2 and 4, an inner plug skirt 38, depending from the cap top 12, has an inwardly directed or converging conical section 42 which contacts the end of the internal neck surface 28 at 44 corner to create a secondary seal which magnifies the closing force exerted by the upper surface 34 of the cap thread 16 acting against the lower surface 36 of the container neck thread 18. The secondary seal is self centering and absorbs variations in the container bore, and it takes over if the flexible rotary seal fails due to container bore imperfections.

In the embodiment of FIGS. 1 and 2, a rotary seal end portion 40 of the inner plug skirt 38 diverges outwardly from the conical section 42 creating a continuous rotary seal with the internal container neck surface 28, the seal being maintained after the secondary seal is broken during unthreading of the closure from the container neck.

In the embodiment of FIG. 4, a cylindrical portion 46 of the inner plug skirt 38 extends vertically down from the conical section 42 creating a continuous rotary seal with an inwardly directed bead 48 on the internal container neck surface 28.

I claim:

1. A sealing closure for application to a threaded container neck comprising:

a top;

a cylindrical cap skirt depending from a periphery of said top, said cap skirt having an internal thread for engagement with said threaded container neck; and a dual sealing plug comprising an inner skirt depending from said top inwardly of said cap skirt for engaging an internal surface of said container neck, said plug including:

an inwardly directed conical section depending from said cap top contacting said internal neck surface at a corner with an adjacent lip of said container neck creating a secondary seal; and a rotary seal portion extending downwardly from said conical section creating a continuous rotary seal with the internal neck surface.

2. The closure according to claim 1 wherein said rotary seal portion of the plug includes an end portion diverging outwardly from said conical section to contact the cylindrical internal surface of said container neck to create said continuous rotary seal.

3. The closure according to claim 1 wherein said rotary seal portion of the plug extends vertically down from said conical section to provide a cylindrical portion which is contacted by a bead extending inwardly from the cylindrical internal surface of the container neck to create said continuous rotary seal.

* * * * *